US010799941B2

(12) United States Patent
Nagasaka et al.

(10) Patent No.: US 10,799,941 B2
(45) Date of Patent: Oct. 13, 2020

(54) FLASK MATING MISALIGNMENT DETECTION METHOD AND DETECTION DEVICE FOR MOLDS WITH FLASKS

(71) Applicant: SINTOKOGIO, LTD., Nagoya-shi (JP)

(72) Inventors: Masahiko Nagasaka, Toyokawa (JP); Hiroyasu Makino, Toyokawa (JP); Katsuaki Odagi, Toyokawa (JP)

(73) Assignee: SINTOKOGIO, LTD., Nagoya (JP)

( * ) Notice: Subject to any disclaimer, the term of this patent is extended or adjusted under 35 U.S.C. 154(b) by 126 days.

(21) Appl. No.: 16/210,585

(22) Filed: Dec. 5, 2018

(65) Prior Publication Data

US 2019/0176223 A1 Jun. 13, 2019

(30) Foreign Application Priority Data

Dec. 12, 2017 (JP) ..... 2017-237387

(51) Int. Cl.

| | |
|---|---|
| ***B22C 21/10*** | (2006.01) |
| ***B22C 21/12*** | (2006.01) |
| ***B22C 19/04*** | (2006.01) |
| ***B22C 21/08*** | (2006.01) |
| *B22C 15/08* | (2006.01) |

(52) U.S. Cl.

CPC ..... *B22C 21/10* (2013.01); *B22C 19/04* (2013.01); *B22C 21/08* (2013.01); *B22C 21/12* (2013.01); *B22C 15/08* (2013.01)

(58) Field of Classification Search

CPC ..... B22C 21/10; B22C 21/08; B22C 21/12; B22C 19/04

See application file for complete search history.

(56) References Cited

U.S. PATENT DOCUMENTS 6,015,007 A 1/2000 Hunter et al.

FOREIGN PATENT DOCUMENTS

| | | | |
|---|---|---|---|
| EP | 1837099 | A2 | 9/2007 |
| GB | 117539 | A | 7/1918 |
| JP | S58-061347 | U | 4/1983 |
| JP | H05-293615 | A | 11/1993 |
| JP | H06-277799 | A | 10/1994 |
| JP | 2015-160219 | A | 9/2015 |

OTHER PUBLICATIONS

Apr. 5, 2019 Extended Search Report issued in European Application No. 18211593.1.

*Primary Examiner* — Kevin P Kerns
*Assistant Examiner* — Steven S Ha
(74) *Attorney, Agent, or Firm* — Oliff PLC

(57) ABSTRACT

[Problem] To provide a method and device that automatically detects misalignment during flask mating in an automatic flask mating device for molding flasks for casting.

[Solution] In an automatic flask mating device, an external force applied to a cope with a cope molding flask M1 during flask mating is detected by means of a physical quantity detection sensor 60, quantified by a computation/storage/determination processing device 61, and then compared with a numerical value at a normal time for determination to thereby determine whether the flask mating has normally completed and detect flask mating misalignment. A force sensor is preferably used as the physical quantity detection sensor.

12 Claims, 9 Drawing Sheets

[FIG. 1]
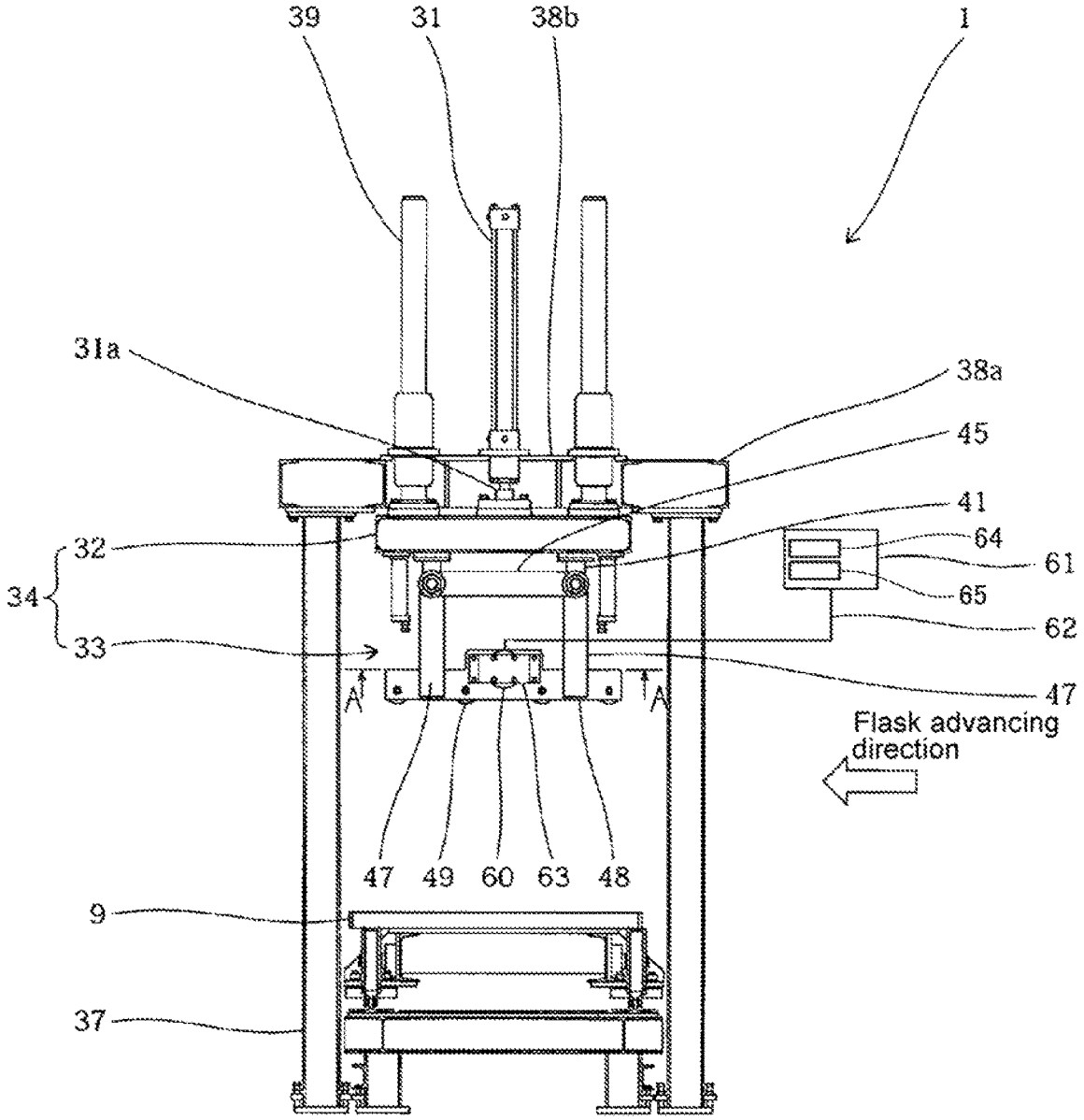

[FIG. 2]
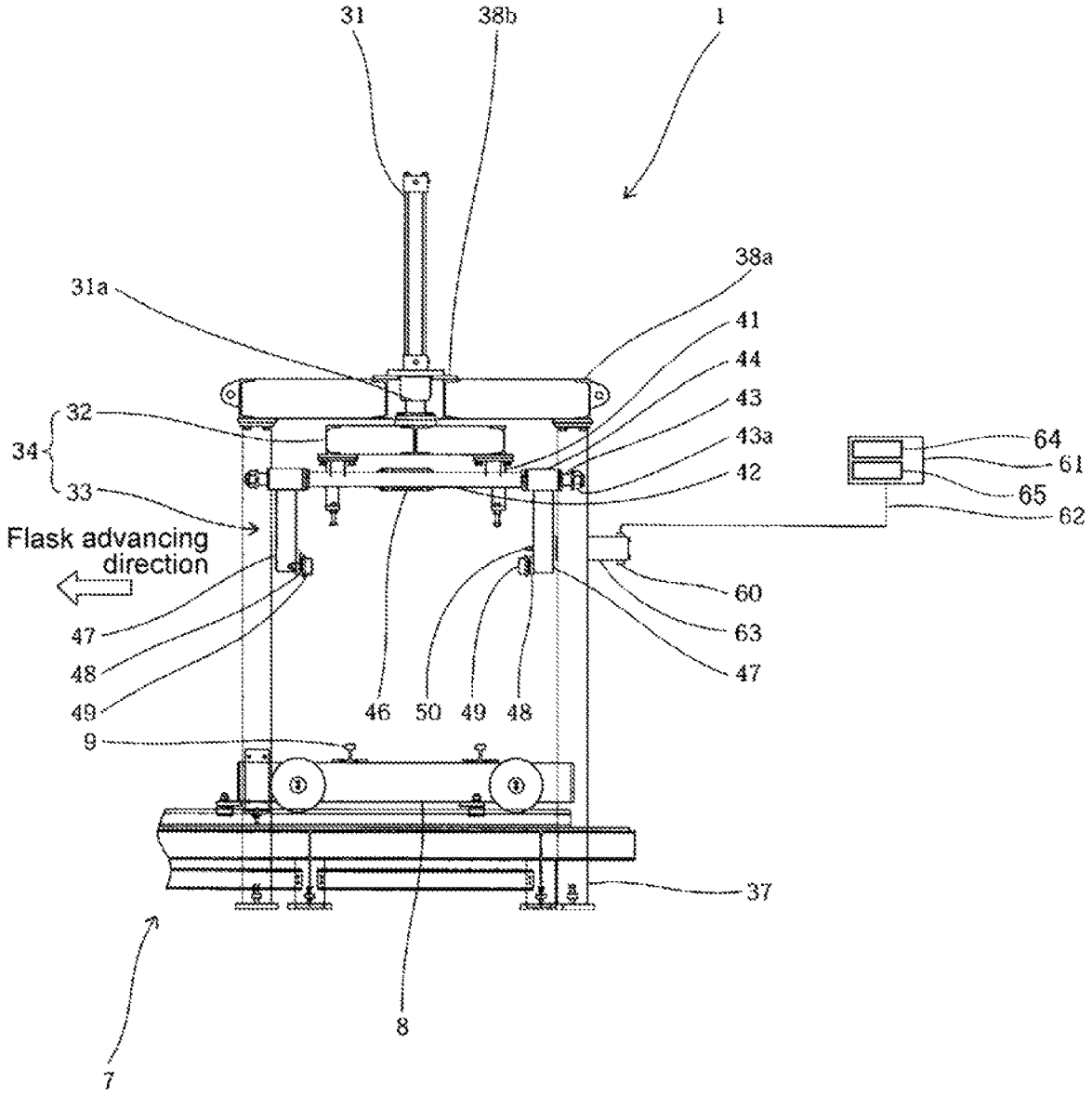

[FIG. 3]
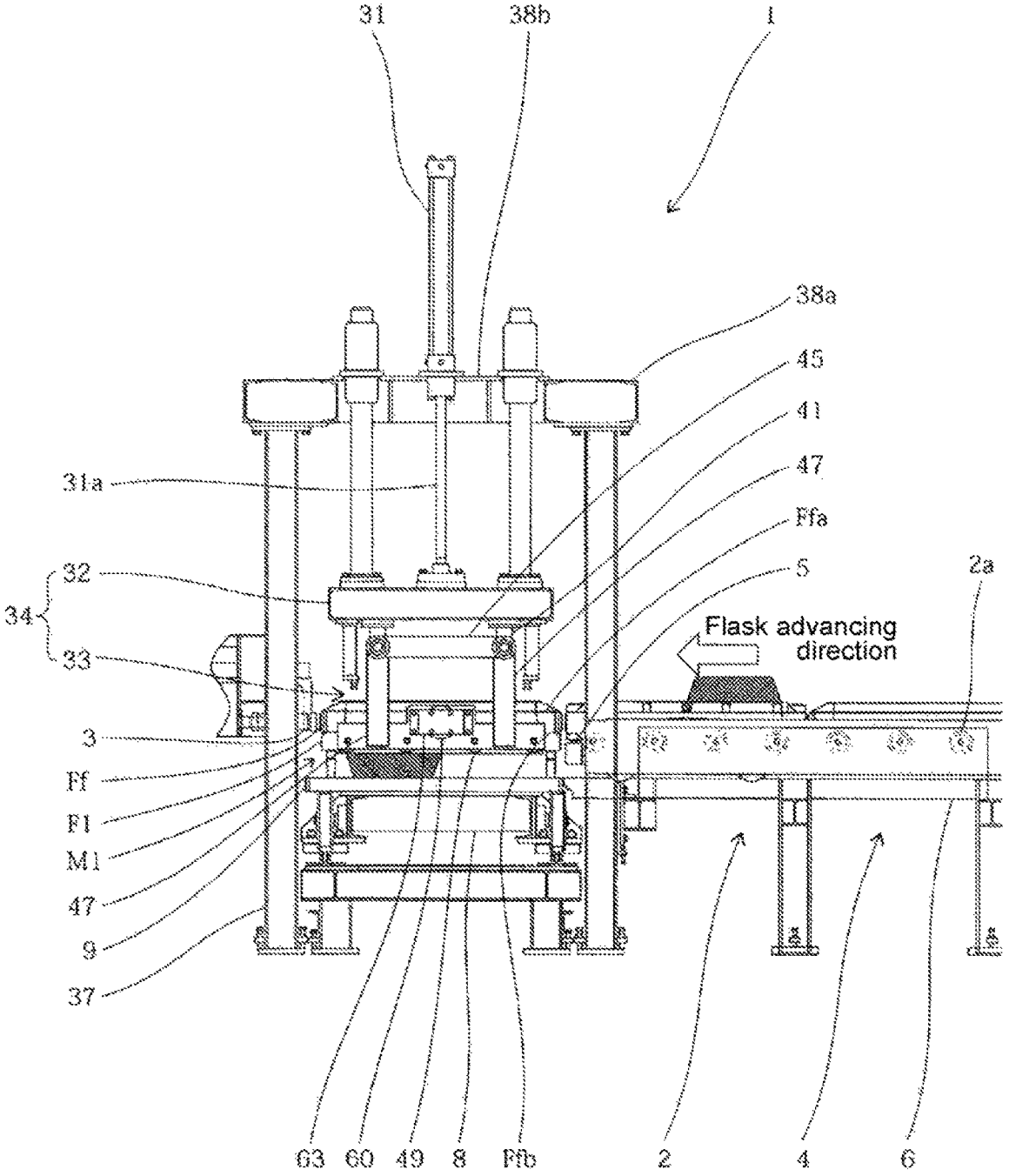

[FIG. 4]
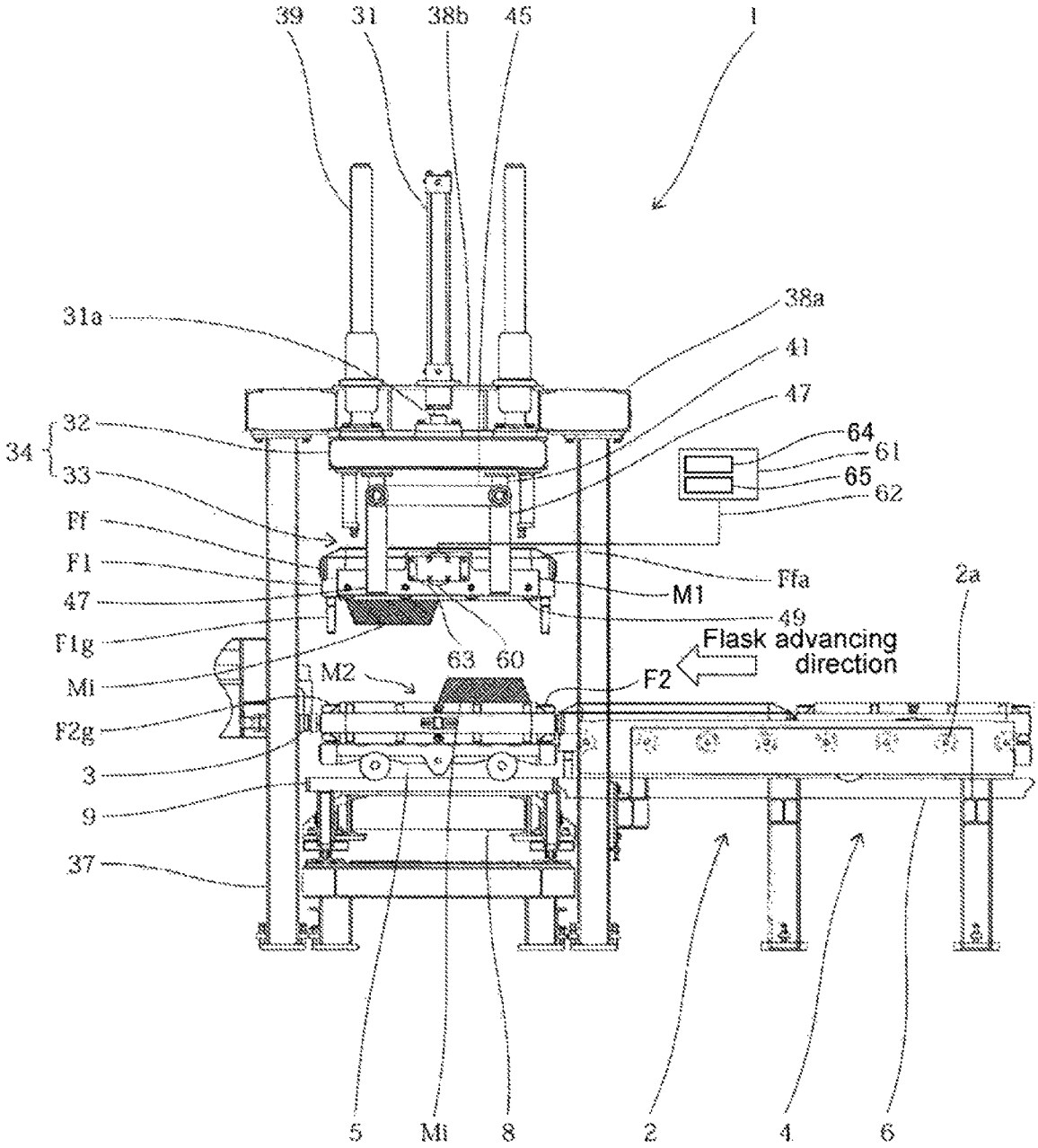

[FIG. 5]
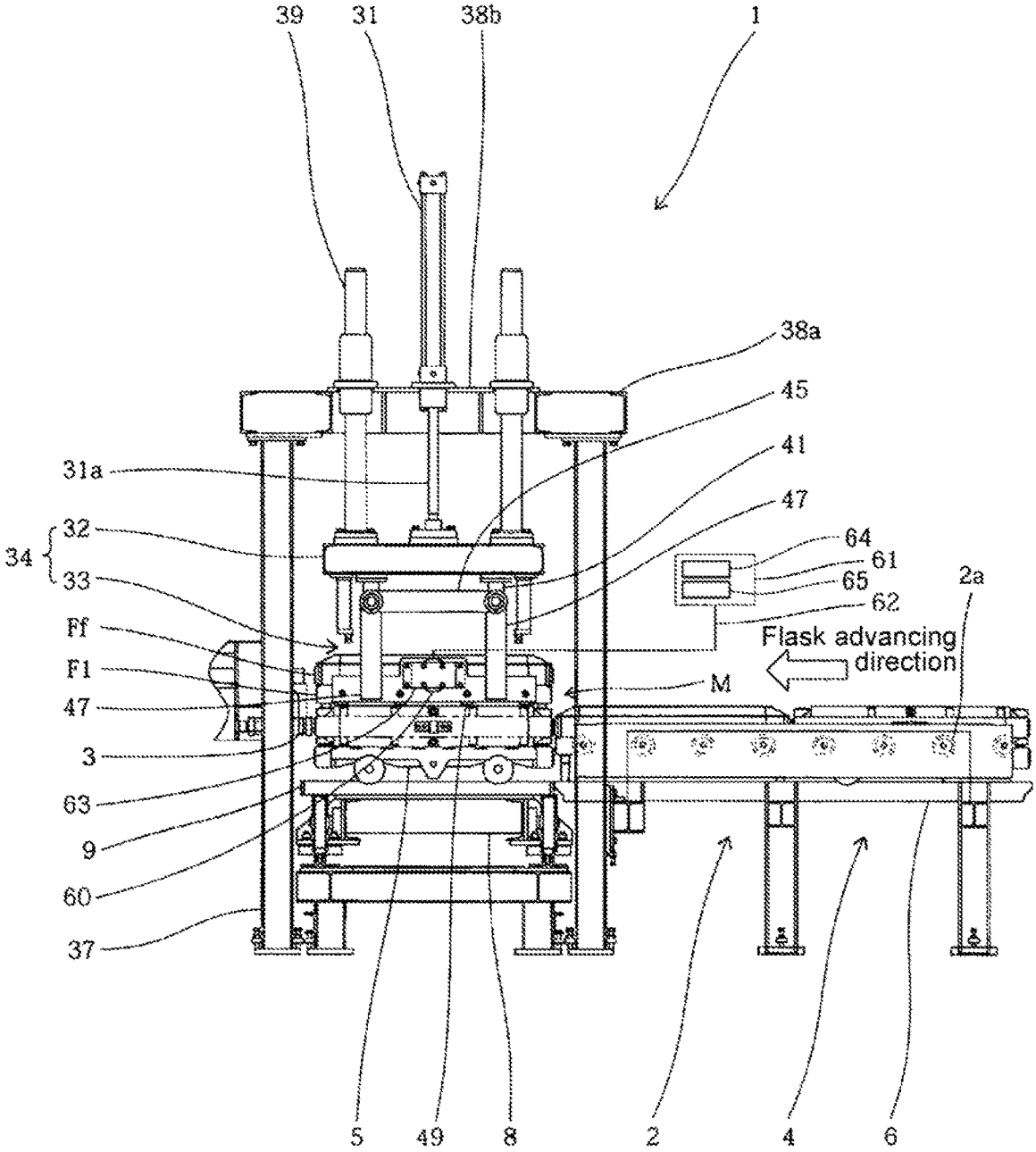

[FIG. 6]
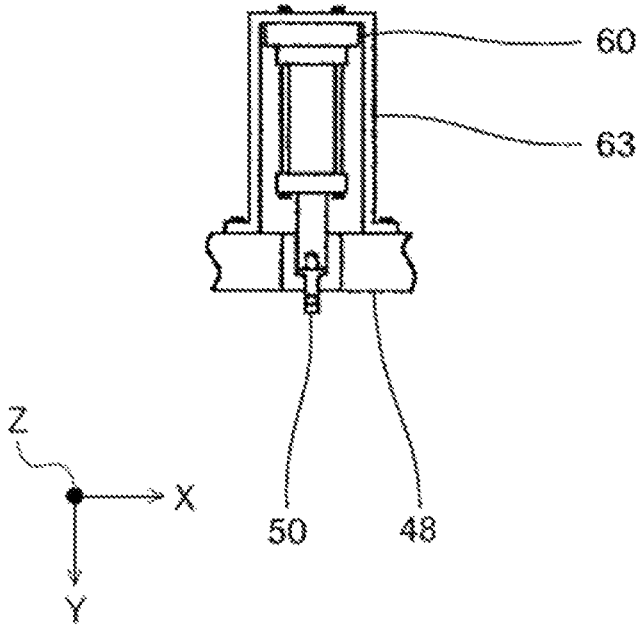

[FIG. 7]
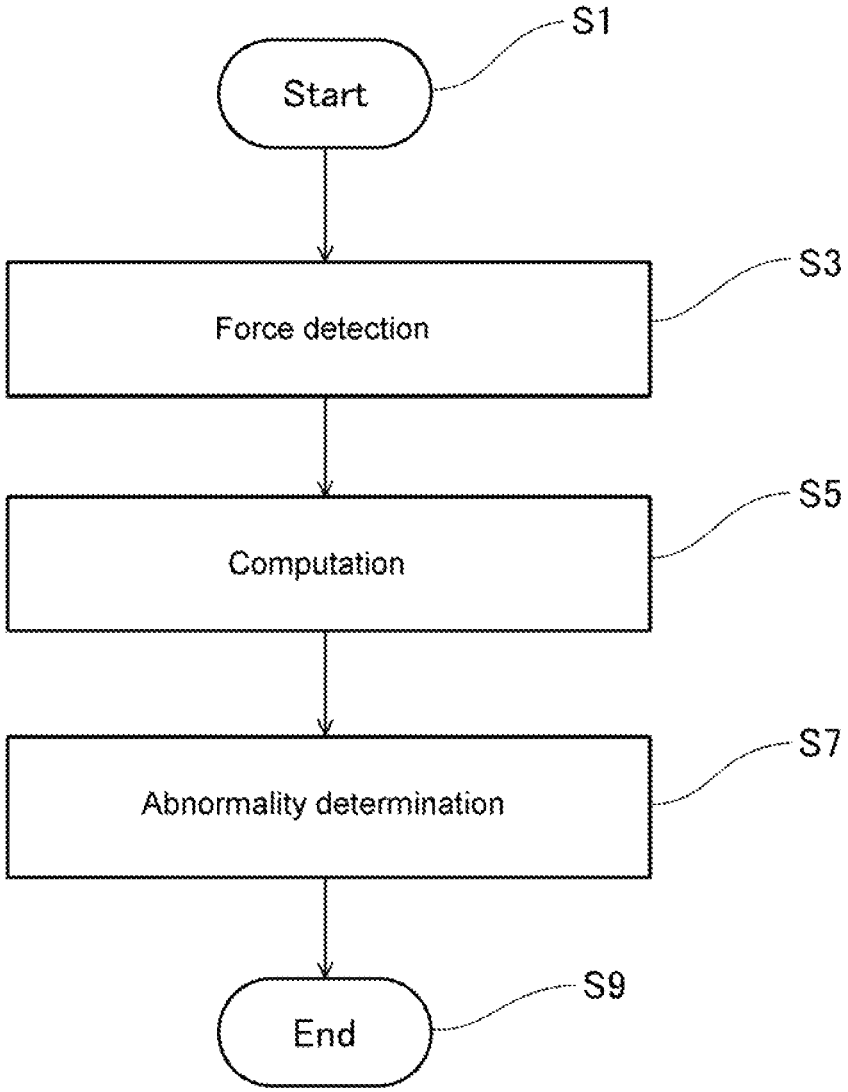

[FIG. 8]
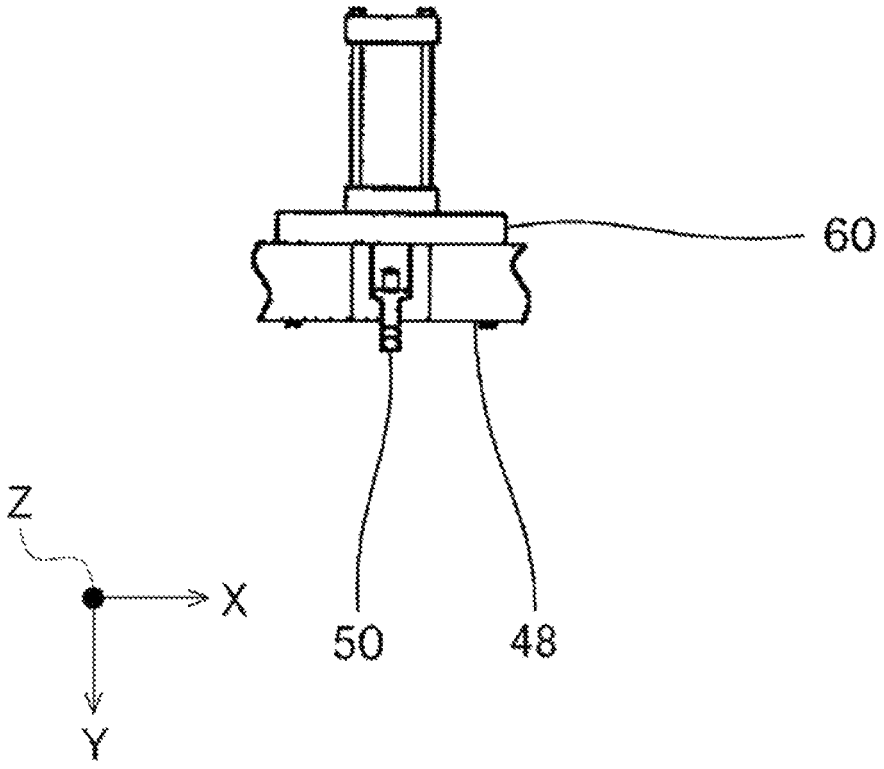

[FIG. 9]
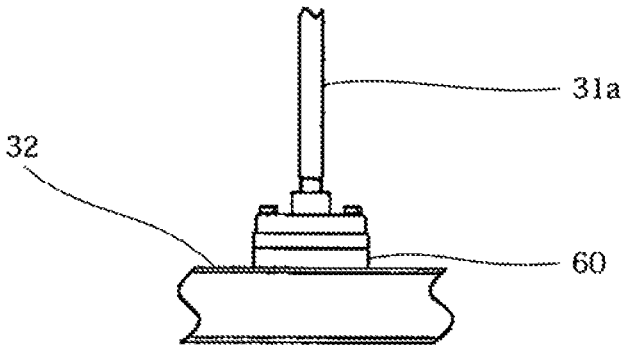

FLASK MATING MISALIGNMENT DETECTION METHOD AND DETECTION DEVICE FOR MOLDS WITH FLASKS

TECHNICAL FIELD

The present invention relates to a method and device for detecting misalignment of flask mating in flask mating for molds with flasks.

BACKGROUND

Conventionally, for the flask mating of molding flasks for casting, a method has been used in which a cope with a cope molding flask and a drag with a drag molding flask molded by a molding machine are automatically flask-mated.

To perform automatic flask mating for molding flasks for casting with the method described above, a method has been taken in which, generally, a cope with a cope molding flask is raised by an automatic flask mating device, a drag with a drag molding flask is conveyed directly below the cope with a cope molding flask, and then the cope with a cope molding flask is stacked on top of the drag with a drag molding flask and flask mating is performed. A method has been proposed where, at this time, the cope and drag molding flasks are flask-mated by being positioned by means of pins and bushings provided on the molding flasks such that molds do not become misaligned. (For example, Patent Documents 1 and 2.)

CITATION LIST

Patent Literature

[Patent Document 1] JP 2015-160219 A
[Patent Document 2] JP S58-061347 U

SUMMARY OF INVENTION

Technical Problem

However, with the techniques described in Patent Documents 1 and 2, it would not be possible to avoid wear caused by friction from repeated fittings as well as friction due to sand dust particles specific to casting factories, even in the case of pins and bushings finished to a high hardness by means of quenching and the like. If pins and bushings wear, problems naturally arise in flask mating accuracy, causing casting defects such as misalignment, mismatches, mold shifts, and flash, which has been a problem.

In addition, molds and cores would become damaged due to interference between copes and drags or interference between molds and cores during flask mating. Operators were separating cope and drag flasks immediately after flask mating to visually check whether molds or cores were damaged, meaning there was a problem in terms of longer cycle times as well as an increased workload for operators.

Thus, the present invention was made in order to solve the problem of flask mating misalignment for molds with flasks. The present invention has the purpose of solving the problem of flask mating misalignment of molds with flasks to make it possible to prevent casting defects resulting from misalignment of flask mating beforehand, and be able to automatically determine interference between the copes and drags or interference between molds and cores during flask mating.

Solution to Problem

To achieve the purpose described above, in the present invention, a technical means is used in which, when automatically flask mating a cope with a cope molding flask and a drag with a drag molding flask molded by a molding machine, a force generated by the fitting together of pins and bushings provided on the cope molding flask and the drag molding flask is detected by means of a physical quantity detection sensor capable of detecting the force, and then a determination is made as to whether the flask mating has normally completed without misalignment on the basis of an engagement force computed from an output of the physical quantity detection sensor.

In addition, in the present invention, a technical means is used in which, when automatically flask mating a cope with a cope molding flask and a drag with a drag molding flask molded by a molding machine, a force generated by the combining of the cope and the drag is detected by means of a physical quantity detection sensor capable of detecting the force, and then a determination is made as to whether the flask mating has normally completed without misalignment on the basis of a combining force detected by the physical quantity detection sensor.

In the present invention, a technical means is used in which a flask mating misalignment detection device for molds with flasks incorporated into an automatic flask mating device that automatically flask-mates a cope with a cope molding flask and a drag with a drag molding flask molded by a molding machine, wherein the cope with a cope molding flask and the drag with a drag molding flask comprise a positioning means comprising pins and bushings, comprises: a physical quantity detection sensor that detects a force generated when the cope with a cope molding flask is lowered toward the drag with a drag molding flask and the pins and the bushings are fitted together; a computation means that computes a fitting force on the basis of the force measured by the physical quantity detection sensor; and a determination means that determines whether the flask mating has normally completed on the basis of the computation result of the computation means.

In the present invention, a technical means is used in which a flask mating misalignment detection device for molds with flasks incorporated into an automatic flask mating device that automatically flask-mates a cope with a cope molding flask and a drag with a drag molding flask molded by a molding machine comprises: a physical quantity detection sensor that detects a force generated when the cope with a cope molding flask is lowered toward the drag with a drag molding flask and flask mating is performed; a computation means that computes a combining force on the basis of the force measured by means of the physical quantity detection sensor; and a determination means that determines whether the flask mating has normally completed on the basis of the computation result of the computation means.

A force sensor is preferably used as the physical quantity detection sensor.

Advantageous Effects of Invention

According to the present invention, a force generated by the fitting together of pins and bushings during flask mating is detected by means of a physical quantity detection sensor, a fitting force is computed by a computation means on the basis of the detected force, and then whether flask mating of a cope with a cope molding flask and a drag with a drag molding flask has normally completed without misalignment can be determined by means of a determination means on the basis of the computation result. This makes it possible to immediately and automatically grasp the occurrence of misalignment, even if pins and bushings become worn due to friction caused by repeated fittings as well as friction caused by sand dust particles specific to casting factories and lead to problems with flask mating accuracy, in turn causing the occurrence of misalignment in the flask mating of a cope with a cope molding flask and a drag with a drag molding flask.

In addition, according to the present invention, a force generated by the combining of a cope and a drag during flask mating is detected by means of a physical quantity detection sensor, a combining force is computed by means of a computation means on the basis of the detected force, and then whether flask mating of the cope with a cope molding flask and the drag with a drag molding flask has normally completed without misalignment can be determined by means of a determination method on the basis of the computation result. This makes it possible to immediately and automatically grasp damage to molds, even if a mold were to be damaged by interference between the cope and the drag due to flask mating misalignment.

BRIEF DESCRIPTION OF DRAWINGS

FIG. 1 is a front view of important parts of an automatic flask mating device for molds with flasks pertaining to an embodiment of the present invention.

FIG. 2 is a right-side view of important parts of an automatic flask mating device for molds with flasks pertaining to an embodiment of the present invention.

FIG. 3 is a front view describing a state in which a cope flask has been conveyed to a working position of conveying rollers.

FIG. 4 is a right-side view describing a state in which conveying rollers have lifted the cope flask and are in an elevated position, and a drag flask has been conveyed underneath the cope flask.

FIG. 5 is a front view describing a state in which the conveying rollers are in a midway (intermediate) stopped position during flask mating.

FIG. 6 is a perspective view along important parts (perspective view along arrows A-A in FIG. 1) of a physical quantity detection sensor installation position.

FIG. 7 is a flow chart of a flask mating misalignment detection method for molds with flasks according to the embodiment described above.

FIG. 8 is a figure describing a modified example of a physical quantity detection sensor installation method.

FIG. 9 is a figure describing a modified example of a physical quantity detection sensor installation method.

DESCRIPTION OF EMBODIMENTS

An embodiment of the present invention is described below with reference to the drawings. As shown in FIG. 3-5, an automatic flask mating device 1 in the present embodiment alternately places a cope with a cope flask (cope with a cope molding flask) M1 and a drag with a drag flask (drag with a drag molding flask) M2 molded by a molding machine (not shown) on a roller conveyor 2, and is provided at the downstream end of a first conveying line 4 in which flasks are sent out one at a time by a pusher cylinder (not shown) arranged on the right-side space of FIG. 3 and a cushion cylinder 3. A pair of fixed rails 6, which guide a first conveying line molding board carriage 5 on which the drag with a drag flask M2 is placed along the first conveying line 4, are attached to the roller conveyor 2 of the first conveying line 4 arranged upstream of the automatic flask mating device 1 and alternately conveying the cope with a cope flask M1 and the drag with a drag flask M2.

In addition, an inverting machine (not shown) that inverts the cope with a cope flask M1 is installed on the first conveying line 4. After the cope with a cope flask M1 is vertically inverted by the inverting machine and the cope with a cope flask M1 and the drag with a drag flask M2 are flask-mated, the flask-mated cope and drag with flasks M are sent out to a second conveying line 7 (FIG. 2) leading to a pouring machine (not shown) installed at a location in a direction perpendicular to the paper plane in FIG. 3. In the present embodiment, in order to send out the flask-mated cope and drag with flasks M to the second conveying line 7, a pair of molding board carriage upper rails 9 is attached to extension lines of the fixed rails 6. The molding board carriage upper rails 9 are fixed so as to be integrally movable on an upper portion of a second conveying line molding board carriage 8 that runs along the second conveying line 7. The second conveying line molding board carriage 8 is sent out, together with the first conveying line molding board carriage 5 that has been guided along the molding board carriage upper rails 9 as well as the cope and drag with flasks M on the first conveying line molding board carriage 5, to the second conveying line 7 by an actuator (not shown).

A cope flask protrusion Ff is formed on both opposite ends of the cope flask (cope molding flask) F1 of the cope with a cope flask M1. In addition, both the upper and lower surfaces of the cope flask protrusion Ff are processed because of the rolling of rollers 2*a* of the roller conveyor 2 that convey the cope with a cope flask M1. Among a cope flask protrusion upper surface processed surface Ffa and a cope flask protrusion lower surface processed surface Ffb processed on both the upper and lower surfaces, conveying rollers 49 to be described later in more detail can be attached to and removed from the cope flask protrusion lower surface processed surface Ffb by means of an also later-described lifting action of a first lifting cylinder 31 and an opening and closing action of an opening and closing cylinder 46.

The automatic flask mating device according to the present embodiment comprises: a first lifting cylinder 31; and a lifting portion 34, comprising a lifting table 32 fixed to a tip of a rod 31*a* of the first lifting cylinder 31 and a support mechanism 33 provided on the lifting table 32.

The first lifting cylinder 31 is provided with an encoder (not shown) as a detector to be able to detect displacement positions of the rod 31*a*, and among four-sided frames 38*a* disposed over four support columns 37 erected on the floor surface and a central frame 38*b*, the cylinder is provided downward on the central frame 38*b*. In addition, a guide rod 39 is provided on both sides of the first lifting cylinder 31. To measure displacement of the rod 31*a*, a linear scale (not shown) may for example be used as a detector instead of the encoder. In addition, a hydraulic cylinder, an air cylinder, or an electric cylinder may be used as the first lifting cylinder 31.

As shown in FIGS. 1 and 2, the support mechanism 33 comprises: support members 41 formed on the lower surface of the lifting table 32; a pair of horizontal members 42 fixed to the support members 41 along a direction orthogonal to the direction in which the cope with a cope molding flask M1 and the drag with a drag molding flask M2 are conveyed along the first conveying line 4 (hereinafter simply referred to as conveying direction); a guide pin 43 formed on both ends of the horizontal members 42; a pair of moving members 45 having holders 44 fitted to the guide pins 43; an opening and closing cylinder 46, both ends of which are pin-connected to the central inner side of the pair of moving members 45; four arms 47 suspended from the holders 44; a pair of roller frames 48 fixed to a lower end of the arms 47 adjacent along the conveying direction; and conveying rollers (free rollers) 49 rotatably supported on an inner surface of each of the roller frames 48. A stopper nut 43*a* of the holder 44 is screwed to a tip of the guide pin 43.

In addition, in the present embodiment, among the pair of roller frames 48, a cope flask clamp 50 that performs positioning of the cope with a cope flask M1 is mounted to one of the roller frames 48 via a mounting member 63 and a physical quantity detection sensor 60 to be described next using FIG. 6. The cope flask clamp 50 comprises a clamp cylinder and a wedge member fixed to a tip of a rod of the clamp cylinder. By extending the rod of the clamp cylinder, the wedge member is inserted between liners installed in the cope flask F1 of the cope with a cope flask M1 such that the cope with a cope flask M1 on the conveying rollers 49 of the roller frames 48 is positioned and fixed.

As shown in FIG. 6, the mounting member 63 with high stiffness is firmly joined to the roller frame 48. The mounting member 63 and the cope flask clamp 50 are mounted so as to be connected via the physical quantity detection sensor 60. A force sensor may be used as the physical quantity detection sensor 60, but is not limited thereto.

The physical quantity detection sensor 60 is capable of detecting a force acting on the cope flask clamp 50 in directions of at least two axes or more. In the present embodiment, the physical quantity detection sensor 60 detects a force in two directions in a horizontal plane. For example, the physical quantity detection sensor 60 detects a force in two axial directions, as in: direction X, the direction in which a side of the cope with a cope flask M1 provided opposite to the roller frames 48 extends; and direction Y, the direction orthogonal to direction X in a horizontal plane and in which the rod of the clamp cylinder extends.

The physical quantity detection sensor 60 is connected to a computation/storage/determination processing device 61 via signal wiring 62. The computation/storage/determination processing device 61 has a function of computing a signal output from the physical quantity detection sensor 60 to derive a value, which is then compared with a previously stored value for determination.

In addition, a drag flask clamp (not shown) for the positioning of the drag with a drag flask M2 relative to the positioning of the cope with a cope flask M1 is mounted to a support column 37.

In the automatic flask mating device 1 configured as described above, first, as shown in FIG. 3, the cope with a cope flask M1, which was sent out from the first conveying line 4 to the automatic flask mating device 1 side, is conveyed onto the conveying rollers 49 in the support mechanism 33 at the lower portion of the lifting table 32, which has been lowered beforehand by the extension of the first lifting cylinder 31. Subsequently, the cope with a cope flask M1 on the conveying rollers 49 is positioned and fixed by operating the cope flask clamp 50.

Next, as shown in FIG. 4, when the cope flask F1 on the conveying rollers 49 in the support mechanism 33 at the lower portion of the lifting table 32 ascends due to the retraction of the first lifting cylinder 31, a drag flask (drag molding flask) F2 of the drag with a drag flask M2 placed on the first conveying line molding board carriage 5 is conveyed onto the molding board carriage upper rails 9.

In this state, as shown in FIG. 5, the first lifting cylinder 31 is extended and the cope flask F1 is lowered onto the conveyed drag flask F2, and the conveying rollers 49 are separated from the cope flask protrusion lower surface processed surface Ffb of the cope flask F1 to complete flask mating.

Here, when the first lifting cylinder 31 is extended and the cope flask F1 is lowered onto the conveyed drag flask F2, positioning pins F1*g* provided on the cope flask F1 and positioning bushings F2*g* provided on the drag flask F2 fit together, thereby allowing the cope with a cope flask M1 and the drag with a drag flask M2 to be flask-mated without any positioning misalignments. In a casting line, because operation is performed such that the combining of the cope flask F1 and the drag flask F2 is continually the same, the external force that occurs on the cope flask F1 when the positioning pins F1*g* provided on the cope flask F1 and the positioning bushings F2*g* provided on the drag flask F2 fit together during flask mating is constant in an ideal state.

When equipment is in a nearly ideal state, for example when a new line is established or line maintenance has completed, the external force that occurs on the cope flask F1 when the positioning pins F1*g* provided on the cope flask F1 and the positioning bushings F2*g* provided on the drag flask F2 fit together is detected by means of the physical quantity detection sensor 60 and stored in the computation/storage/determination processing device 61 beforehand. A computation means 64 that computes a fitting force, the force generated by the fitting together of the pins F1*g* and bushings F2*g* of the cope flask F1 and the drag flask F2, from the external force measured by the physical quantity detection sensor 60; and a determination means 65, which determines whether flask mating has normally completed on the basis of the computation result of the computation means 64, are incorporated into the computation/storage/determination processing device 61. In the case of a general casting line, operation is performed such that the cope flask F1 and the drag flask F2 are continually the same combination. Thus, a numerical value during flask mating for each combination is stored.

However, in practice, the positioning pins F1*g* and the positioning bushings F2*g* become worn as operation continues, causing rattling in the fitting together of the positioning pins F1*g* and the positioning bushings F2*g* and in turn degrading flask mating accuracy. Then, as the external force that occurs on the cope flask F1 when the positioning pins F1*g* provided on the cope flask F1 and the positioning bushings F2*g* provided on the drag flask F2 fit together in flask mating, differing external forces that have deviated from the ideal state occur.

In each flask mating that is performed, the external force that occurs on the cope flask F1 when the positioning pins F1*g* provided on the cope flask F1 and the positioning bushings F2*g* provided on the drag flask F2 fit together is detected by means of the physical quantity detection sensor 60, and in the computation/storage/determination processing device 61, the detection signal is quantified by means of computation and compared with a previously stored numerical value of an ideal state.

Here, for example, the value measured by the physical quantity detection sensor 60 is compared for each axis.

At this time, if the comparison value of the external force detected for each axis in the physical quantity detection sensor 60 is deviating by 200 N (about 20 Kgf) or more even in one axis, or, if the comparison value of the external force detected for each axis moment in the physical quantity detection sensor 60 is deviating by 200 N·m (about 20 kgf·m) or more even in one axial moment, this is determined to be an abnormal state in which misalignment has occurred in flask mating.

FIG. 7 is a flow chart of a flask mating misalignment detection method for molds with flasks in the present embodiment.

In the flask mating misalignment detection method for molds with flasks, once the process is initiated (step S1), when automatically flask mating a cope with a cope flask M1 and a drag with a drag flask M2, a physical quantity detection sensor 60 detects an external force generated by the fitting together of pins F1*g* and bushings F2*g* provided on a cope flask F1 and a drag flask F2 (step S3).

The computation means 64 receives the detection result detected by the physical quantity detection sensor 60 and computes a fitting force (step S5).

A determination means 65 determines whether flask mating has normally completed on the basis of the fitting force, which is the computation result of the computation means 64 (step S7), and the process ends (step S9).

Next, the effects of the flask mating misalignment detection method and detection device for molds with flasks will be described.

The flask mating misalignment detection method for molds with flasks in the present embodiment, when automatically flask mating a cope with a cope molding flask M1 and a drag with a drag molding flask M2 molded by a molding machine, detects a force generated by the fitting together of pins F1*g* and bushings F2*g* provided on a cope molding flask F1 and a drag molding flask F2 by means of a physical quantity detection sensor 60 capable of detecting the force, and determines whether the flask mating has normally completed without misalignment on the basis of a fitting force computed from an output of the physical quantity detection sensor 60.

In addition, the flask mating misalignment detection device for molds with flasks in the present embodiment is incorporated into an automatic flask mating device 1 that automatically flask-mates a cope with a cope molding flask M1 and a drag with a drag molding flask M2 molded by a molding machine, wherein the cope with a cope molding flask M1 and the drag with a drag molding flask M2 comprise a positioning means F1*g* and F2*g* comprising pins F1*g* and bushings F2*g*, and the flask mating misalignment detection device for molds with flasks comprises: a physical quantity detection sensor 60 that detects a force generated when the cope with a cope molding flask M1 is lowered toward the drag with a drag molding flask M2 and the pins F1*g* and the bushings F2*g* are fitted together; a computation means 64 that computes a fitting force on the basis of the force measured by means of the physical quantity detection sensor 60; and a determination means 65 that determines whether the flask mating has normally completed without misalignment on the basis of the computation result of the computation means 64.

According to such a configuration and method, it is possible to automatically detect flask mating abnormalities that occur due to wearing of the positioning pins F1*g* and the positioning bushings F2*g*, in turn allowing countermeasures to be taken, such as not pouring molten metal into cope and drag with flasks M in which there was flask mating misalignment, and the occurrence rate of casting defects can be reduced. Furthermore, because the wearing of the positioning pins F1*g* and the positioning bushings F2*g* can be automatically detected, predictive maintenance becomes possible. For example, the time of replacement of the positioning pins F1*g* and the positioning bushings F2*g* can be predicted in advance.

(Modified Example of Embodiment)

Next, a modified example of the embodiment above will be described. In the present modified example, the physical quantity detection sensor 60 detects a combining force generated by the combining of a cope and a drag.

As indicated above, when the first lifting cylinder 31 is extended and the cope flask F1 is lowered onto the conveyed drag flask F2, the external force that occurs on the cope flask F1 due to flask mating is constant in an ideal state if molds, such as an island portion Mi of the cope with a cope flask M1 and an island portion Mi of the drag with a drag flask M2, complete flask mating without interference.

When equipment is in a nearly ideal state, for example when a new line is established or line maintenance has completed, the external force that occurs on the cope flask F1 due to flask mating, when molds such as the island portion Mi of the cope with a cope flask M1 and the island portion Mi of the drag with a drag flask M2 complete flask mating without any interference in flask mating, is detected by means of the physical quantity detection sensor 60 and stored in the computation/storage/determination processing device 61 beforehand. At this time in the case of a general casting line, operation is performed such that the cope flask F1 and the drag flask F2 are continually the same combination. Thus, a numerical value during flask mating for each combination is stored.

However, molding problems and the like can occur as operation continues. There can be interference between molds such as the island portion Mi of the cope with a cope flask M1 and the island portion Mi of the drag with a drag flask M2 in flask mating. This means, as the external force that occurs on the cope flask F1, differing external forces that have deviated from the ideal state occur.

In each flask mating that is performed, the external force that occurs on the cope flask F1 during flask mating is detected by means of the physical quantity detection sensor 60, and in the computation/storage/determination processing device 61, the detection signal is quantified by means of computation to obtain a combining force, which is compared with a previously stored numerical value of the ideal state.

Here, for example, the value measured by the physical quantity detection sensor 60 is compared for each axis.

At this time, if the comparison value of the external force detected for each axis in the physical quantity detection sensor 60 is deviating by 50 N (about 5 kgf) or more even in one axis, or, if the comparison value of the external force detected for each axis moment in the physical quantity detection sensor 60 is deviating by at least 50 N·m (about 5 kgf·m) even in one axial moment, this is determined to be an abnormal state in which misalignment has occurred in flask mating.

The flask mating misalignment detection method for molds with flasks in the present modified example is implemented in a manner similar to the embodiment described using FIG. 7.

In other words, once the process is initiated (step S1), when automatically flask mating a cope with a cope flask M1 and a drag with a drag flask M2, a physical quantity detection sensor 60 detects an external force generated by the combining of a cope flask F1 and a drag flask F2 (step S3).

A computation means 64 receives the detection result detected by the physical quantity detection sensor 60 and computes a combining force (step S5).

A determination means 65 determines whether flask mating has normally completed on the basis of the combining force, which is the computation result of the computation means 64 (step S7), and the process ends (step S9).

The flask mating misalignment detection method for molds with flasks in the present modified example, when automatically flask mating a cope with a cope molding flask M1 and a drag with a drag molding flask M2 molded by a molding machine, detects a force generated by the combining of a cope F1 and a drag F2 by means of a physical quantity detection sensor 60 capable of detecting the force, and determines whether the flask mating has normally completed without misalignment on the basis of a combining force detected by means of the physical quantity detection sensor 60.

In addition, the flask mating misalignment detection device for molds with flasks in the present modified example is incorporated into an automatic flask mating device 1 that automatically flask-mates a cope with a cope molding flask M1 and a drag with a drag molding flask M2 molded by a molding machine, wherein the flask mating misalignment detection device for molds with flasks comprises: a physical quantity detection sensor 60 that detects a force generated when the cope with a cope molding flask M1 is lowered toward the drag with a drag molding flask M2 and flask mating is performed; a computation means 64 that computes a combining force on the basis of the force measured by the physical quantity detection sensor 60; and a determination means 65 that determines whether the flask mating has normally completed on the basis of the computation result of the computation means 64.

According to such a configuration and method, it is possible to automatically detect flask mating abnormalities that occur due to interference between the cope with a cope flask M1 and the drag with a drag flask M2, in turn allowing countermeasures to be taken, such as not pouring molten metal into cope and drag with flasks M for which abnormalities were detected, and the occurrence rate of casting defects can be reduced. Furthermore, because interference between the cope with a cope flask M1 and the drag with a drag flask M2 due to molding abnormalities can be automatically detected, the frequency of abnormalities can be automatically made clear and predictive maintenance becomes possible. For example, the time of maintenance for the molding machine can be predicted in advance.

Other Modified Examples

The installation position of the physical quantity detection sensor 60 can be changed. For example, as shown in FIG. 8, the roller frame 48 and the cope flask clamp member 50 can be mounted so as to be connected via the physical quantity detection sensor 60. In addition, for example, as shown in FIG. 9, the physical quantity detection sensor 60 may be sandwiched between the rod 31*a* of the first lifting cylinder 31 and the lifting table 32, and the rod 31*a* and the lifting table 32 may be mounted so as to be connected via the physical quantity detection sensor 60. Furthermore, the support column 37 and the drag flask clamp (not shown) may be mounted so as to be connected via the physical quantity detection sensor 60, and may be mounted anywhere in the automatic flask mating device 1 so long as the location allows the external force acting on the cope with a cope flask to be detected whether directly or indirectly.

In addition, in the embodiment described above, the physical quantity detection sensor 60 detects a force in two axial directions, as in: direction X, the direction in which a side of the cope with a cope flask M1 provided opposite to the roller frame 48 extends; and direction Y, the direction orthogonal to direction X in a horizontal plane and in which the rod of the clamp cylinder extends, but is not limited thereto. For example, a force in two axial directions, as in the above-described direction X and direction Z orthogonal to both direction X and direction Y, may be detected, and a force in two axial directions, as in direction Y and direction Z, may be detected. A force in three axial directions, as in directions X, Y, and Z, may also be detected. The axial direction is not limited to the above-described directions X, Y, and Z, and may be other directions. In addition, force detection can also include moment detection. In other words, the physical quantity detection sensor 60 may for example be configured so as to be able to detect at least two values from among a total of six types of values as in the force in each of the axial directions X, Y, and Z and the moment about each of these axial directions.

REFERENCE SIGNS LIST

F1 Cope flask (cope molding flask)
Ff Cope protrusion
Ffa Cope protrusion upper surface processed surface
Ffb Cope protrusion lower surface processed surface
F1*g* Positioning pin (positioning means)
F2 Drag (drag molding flask)
F2*g* Positioning bushing (positioning means)
M Cope and drag with flasks
M1 Cope with a cope flask (cope with a cope molding flask)
M2 Drag with a drag flask (drag with a drag molding flask)
Mi Island portion
1 Automatic flask mating device
2 Roller conveyor
2*a* Roller
3 Cushion cylinder
4 First conveying line
5 First conveying line molding board carriage
6 Fixed rail
7 Second conveying line
8 Second conveying line molding board carriage
9 Molding board carriage upper rail
31 First lifting cylinder
31*a* Rod
32 Lifting table
33 Support mechanism
34 Lifting portion
37 Support column
38*a* Frame
38*b* Central frame
39 Guide rod
41 Support member
42 Horizontal member
43 Guide pin
43*a* Stopper nut
44 Holder
45 Moving member
46 Opening and closing cylinder
47 Arm
48 Roller frame
49 Conveying roller
50 Cope flask clamp
60 Physical quantity detection sensor
61 Computation/storage/determination processing device
62 Signal wiring

63 Mounting member
64 Computation means
65 Determination means

The invention claimed is:

1. A flask mating misalignment detection method for molds with flasks comprising, when automatically flask mating a cope with a cope molding flask and a drag with a drag molding flask molded by a molding machine:

detecting a force generated by a fitting together of pins and bushings provided on the cope molding flask and the drag molding flask by means of a physical quantity detection sensor capable of detecting the force; and determining whether the flask mating has normally completed without misalignment on the basis of a fitting force computed from an output of the physical quantity detection sensor.

2. The flask mating misalignment detection method for molds with flasks according to claim 1, wherein the physical quantity detection sensor is capable of detecting the force in directions of at least two axes or more.

3. The flask mating misalignment detection method for molds with flasks according to claim 1, wherein a force sensor is used as the physical quantity detection sensor.

4. A flask mating misalignment detection method for molds with flasks comprising, when automatically flask mating a cope with a cope molding flask and a drag with a drag molding flask molded by a molding machine:

detecting a combining force generated by combining of the cope and the drag by means of a physical quantity detection sensor capable of detecting the force; and determining whether the flask mating has normally completed without misalignment on the basis of the combining force detected by the physical quantity detection sensor.

5. The flask mating misalignment detection method for molds with flasks according to claim 4, wherein the physical quantity detection sensor is capable of detecting the force in directions of at least two axes or more.

6. The flask mating misalignment detection method for molds with flasks according to claim 4, wherein a force sensor is used as the physical quantity detection sensor.

7. A flask mating misalignment detection device for molds with flasks incorporated into an automatic flask mating device that automatically flask-mates a cope with a cope molding flask and a drag with a drag molding flask molded by a molding machine, wherein:

the cope with the cope molding flask and the drag with the drag molding flask comprise a positioning means comprising pins and bushings; and the flask mating misalignment detection device for molds with flasks comprises:

a physical quantity detection sensor configured to detects a force generated when the cope with the cope molding flask is lowered toward the drag with the drag molding flask and the pins and bushings are fitted together; and a processor configured to function as:

a computation unit configured to computes a fitting force on the basis of the force detected by the physical quantity detection sensor; and a determination unit configured to determine whether the flask mating has normally completed on the basis of the fitting force, which is a computation result of the computation unit.

8. The flask mating misalignment detection device for molds with flasks according to claim 7, wherein the physical quantity detection sensor is capable of detecting the force in directions of at least two axes or more.

9. The flask mating misalignment detection device for molds with flasks according to claim 7, wherein the physical quantity detection sensor is a force sensor.

10. A flask mating misalignment detection device for molds with flasks incorporated into an automatic flask mating device that automatically flask-mates a cope with a cope molding flask and a drag with a drag molding flask molded by a molding machine, wherein the flask mating misalignment detection device for molds with flasks comprises:

a physical quantity detection sensor that detects a force generated when the cope with the cope molding flask is lowered toward the drag with the drag molding flask and flask mating is performed; and a processor configured to function as:

a computation unit configured to compute a fitting force on the basis of the force detected by the physical quantity detection sensor; and a determination unit configured to determine whether the flask mating has normally completed on the basis of the fitting force, which is a computation result of the computation unit.

11. The flask mating misalignment detection device for molds with flasks according to claim 10, wherein the physical quantity detection sensor is capable of detecting the force in directions of at least two axes or more.

12. The flask mating misalignment detection device for molds with flasks according to claim 10, wherein the physical quantity detection sensor is a force sensor.

* * * * *